US009863105B1

(12) United States Patent
Price et al.

(10) Patent No.: US 9,863,105 B1
(45) Date of Patent: Jan. 9, 2018

(54) VEHICLE BARRIER RAPID DEPLOYMENT ASSEMBLY

(71) Applicants: Christopher G. Price, Vicksburg, MS (US); Justin Roberts, Jackson, MS (US); William McCleave, Clinton, MS (US)

(72) Inventors: Christopher G. Price, Vicksburg, MS (US); Justin Roberts, Jackson, MS (US); William McCleave, Clinton, MS (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/282,940

(22) Filed: Sep. 30, 2016

(51) Int. Cl.
*E01F 13/02* (2006.01)
*E01F 13/12* (2006.01)
*E01F 15/00* (2006.01)

(52) U.S. Cl.
CPC ..... *E01F 13/02* (2013.01); *E01F 13/12* (2013.01); *E01F 15/00* (2013.01)

(58) Field of Classification Search
CPC ..... E01F 13/02; E01F 13/12; E01F 13/123; E01F 9/0122; E01F 9/012; E01F 9/0175; E01F 15/148; E01F 15/10; E01F 15/12; E01F 15/00
See application file for complete search history.

(56) References Cited

U.S. PATENT DOCUMENTS 4,822,206 A * 4/1989 Roussel ..... E01F 13/085 404/10
5,146,710 A * 9/1992 Caldwell ..... E01F 13/08 404/6
7,736,086 B2 * 6/2010 Coomber ..... E01F 13/12 404/6
8,215,866 B2 * 7/2012 Whitford ..... F41H 5/14 256/13.1
8,439,594 B1 * 5/2013 Clark ..... E01F 13/08 256/13.1
8,469,627 B2 * 6/2013 Castro ..... E01F 13/12 404/6
8,956,072 B2 * 2/2015 Brackin ..... E01F 13/08 404/6
9,028,166 B2 * 5/2015 Morgan ..... E01F 13/08 404/6
9,228,304 B2 * 1/2016 Brackin ..... E01F 13/08
(Continued)

*Primary Examiner* — Abigail A Risic
(74) *Attorney, Agent, or Firm* — Brian C. Jones

(57) ABSTRACT

A vehicle barrier apparatus includes a vertical barrier component connected to a stabilizer beam and capable of selective deployment by a rapid deployment assembly. One end of the stabilizer beam is rotatably connected to the vertical barrier component. Movement of a locking block in the stabilizer beam using a locking handle connected to a locking shaft allows a tensioning cable and tensioning spring assembly to raise the vertical barrier component. Straps extending around both the vertical barrier component and the stabilizer beam prevent over-extension and provide additional resistance to vehicle impact. The locking handles and shafts of multiple vehicle barrier apparatuses may be connected in series, allowing a user to actuate a single locking handle to simultaneously deploy multiple vertical barrier components.

20 Claims, 6 Drawing Sheets

(56) References Cited

U.S. PATENT DOCUMENTS

Figure 1A:
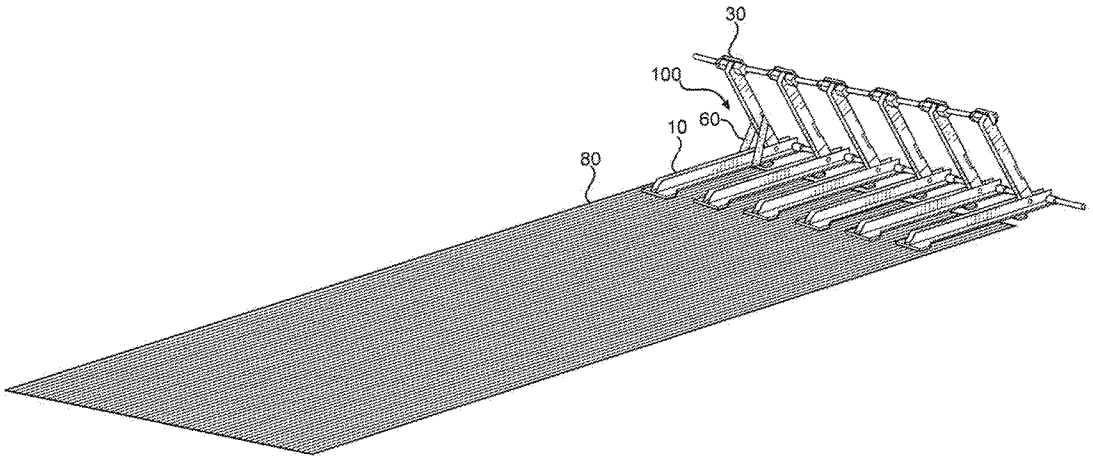

| | | | | |
|---|---|---|---|---|
| 2006/0233609 | A1* | 10/2006 | Gelfand | E01F 13/12 404/6 |
| 2014/0301781 | A1* | 10/2014 | Lindberg | E01F 15/146 404/6 |
| 2016/0115661 | A1* | 4/2016 | Neusch | E01F 13/123 404/6 |
| 2017/0036551 | A1* | 2/2017 | Wu | E01F 13/085 |

* cited by examiner

VEHICLE BARRIER RAPID DEPLOYMENT ASSEMBLY

STATEMENT REGARDING FEDERALLY SPONSORED RESEARCH OR DEVELOPMENT

The invention described herein was made by an employee of the United States Government and may be manufactured and used by the Government of the United States of America for governmental purposes without the payment of any royalties thereon or therefore.

CROSS-REFERENCE TO RELATED APPLICATIONS

This patent application is a continuation-in-part of U.S. application Ser. No. 15/135,312 filed Apr. 21, 2016 and of U.S. application Ser. No. 15/156,065 filed May 16, 2016. This patent application claims the benefit of U.S. Provisional Application No. 62/253,587 filed Nov. 10, 2015 and of U.S. Provisional Application No. 62/337,240 filed May 16, 2016. The above applications are incorporated by reference herein in their entirety.

FIELD OF INVENTION

This invention relates to the field of rapidly deployable traffic barriers which bring vehicles to a controlled stop by interfering with forward motion.

DESCRIPTION OF RELATED ART

Military and law enforcement personnel use vehicle checkpoints and roadblocks to protect an established perimeter. Checkpoints and roadblocks require the use of barriers to control vehicle movement. The barriers are often temporary structures which can be deployed without advance notice to persons in the area.

There are several problems known in the art relating to barrier structures currently available to military and law enforcement personnel. One problem known in the art is that drivers may be surprised by the sudden appearance of a barrier in a roadway. Accordingly, a driver who does not intend to breach a barrier may fail to react quickly enough to avoid inadvertent contact with the barrier. A second problem known in the art is that military and law enforcement personnel are visibly exposed to attackers during the time required to deploy a barrier. Another problem known in the art is that certain areas may require multiple barriers to be fully secured. This increases the time and risk associated with deploying the barriers.

Numerous attempts have been made to design efficient and rapidly deployable barrier devices. For example, U.S. Patent Application No. 2014/0301781 to Lindberg et al proposed the use of a heavy barrier constructed from rebar and tires. This structure requires significant cargo space to transport, and multiple persons for deployment due to its weight.

The US military has consistently sought solutions for rapid deployment of vehicle barriers. The US Army Corps of Engineers, Naval Facilities Engineering Command, the US Air Force, and the State Department have conducted research to design effective barrier devices that reduce risk to civilians and to military and law enforcement personnel.

There is an unmet need for a lightweight, rapidly deployable barrier device that can be flexibly deployed in the specific configuration necessary to secure a particular perimeter.

BRIEF SUMMARY OF THE INVENTION

The present invention is a vehicle barrier apparatus including a stabilizer beam rotatably connected to a vertical barrier component, and a rapid deployment assembly. At least one strap extends around the stabilizer beam and the vertical barrier, keeping the vertical barrier at a specific angle to the stabilizer beam when deployed. The stabilizer beam has a central channel with a block stop plate at a proximal end. The block catch of a locking block within the central channel extends beyond the block stop plate. A biasing spring between the locking block and block stop plate keeps the block in position until deployment. A tensioning cable extends from the proximal end to at least one tensioning spring in lower end of the vertical barrier.

To deploy the vertical barrier, a user actuates a locking handle pivotably coupled to a locking shaft extending through locking channels in the stabilizer beam. As the locking shaft rotates, it causes an attached rotating cam channel, located in the central channel, to rotate as well. As the rotating cam channel turns, a cam on an exterior surface of the rotating cam channel catches the block catch, moving the locking block away from the lower end of the vertical barrier. The tension in the tensioning cable causes the upper end of the vertical barrier to rise and deploy.

Certain embodiments of the present invention link the locking handle of one vehicle barrier apparatus to the locking shaft of another vehicle barrier apparatus. This allows actuation of one locking handle to control deployment of multiple vertical barrier components over multiple vehicle barrier apparatuses.

BRIEF DESCRIPTION OF SEVERAL VIEWS OF THE DRAWING(S)

FIG. 1*a* illustrates a perspective view of an exemplary embodiment of a vehicle barrier apparatus.

Figure 1B:
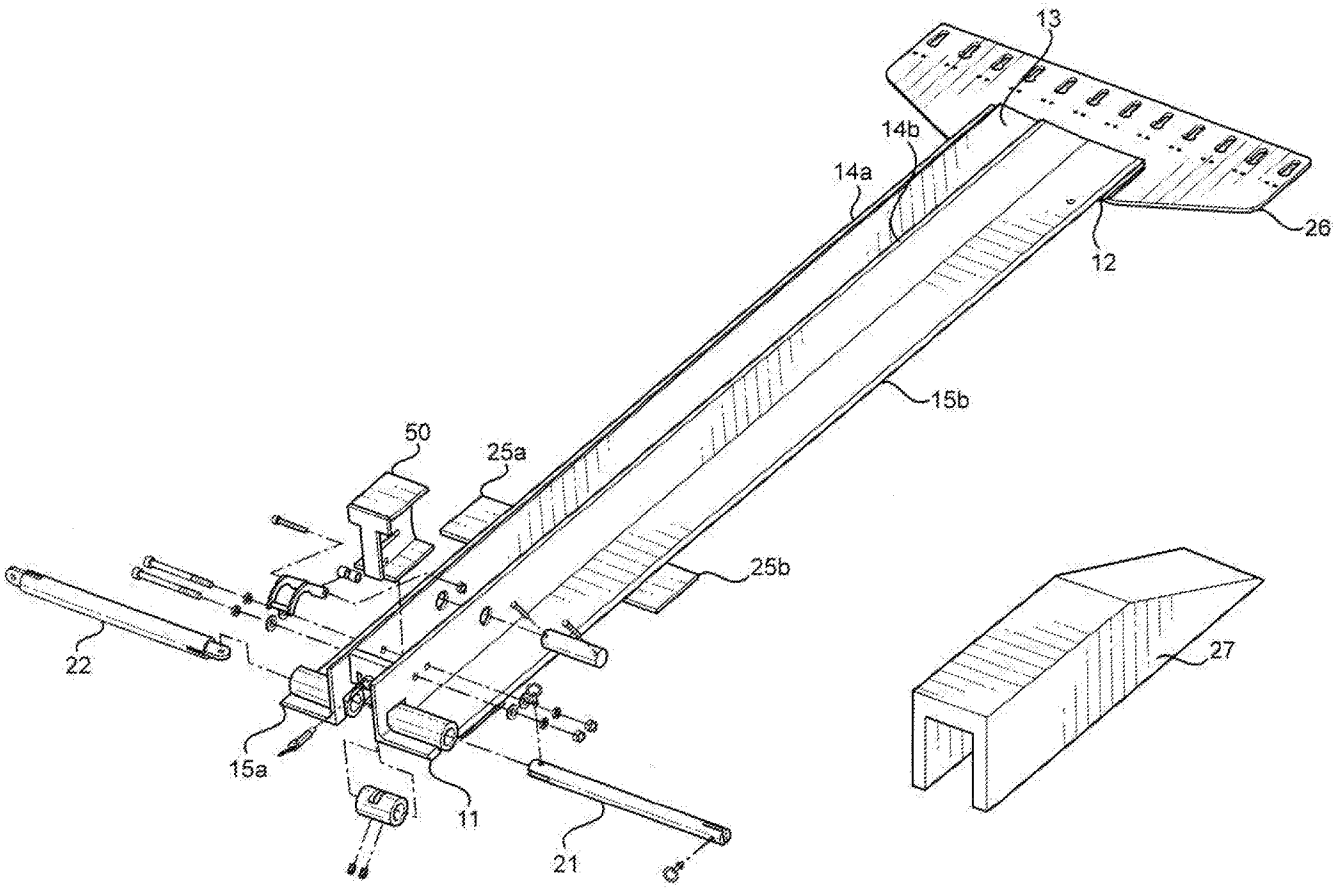
Figure 1C:
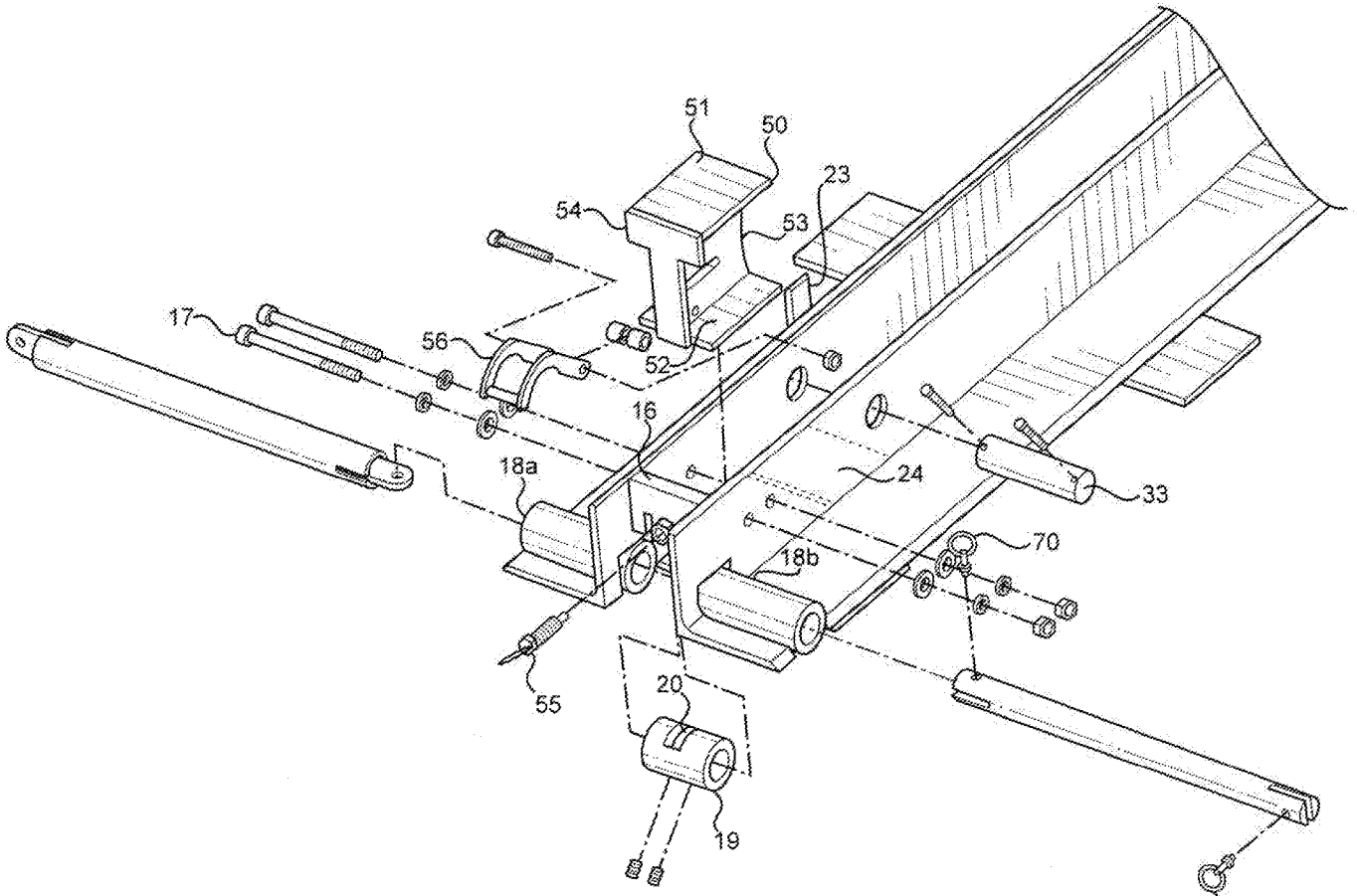

FIGS. 1*b* and 1*c* illustrate perspective and magnified views, respectively, of an exemplary embodiment of a stabilizer beam.

Figure 1D:
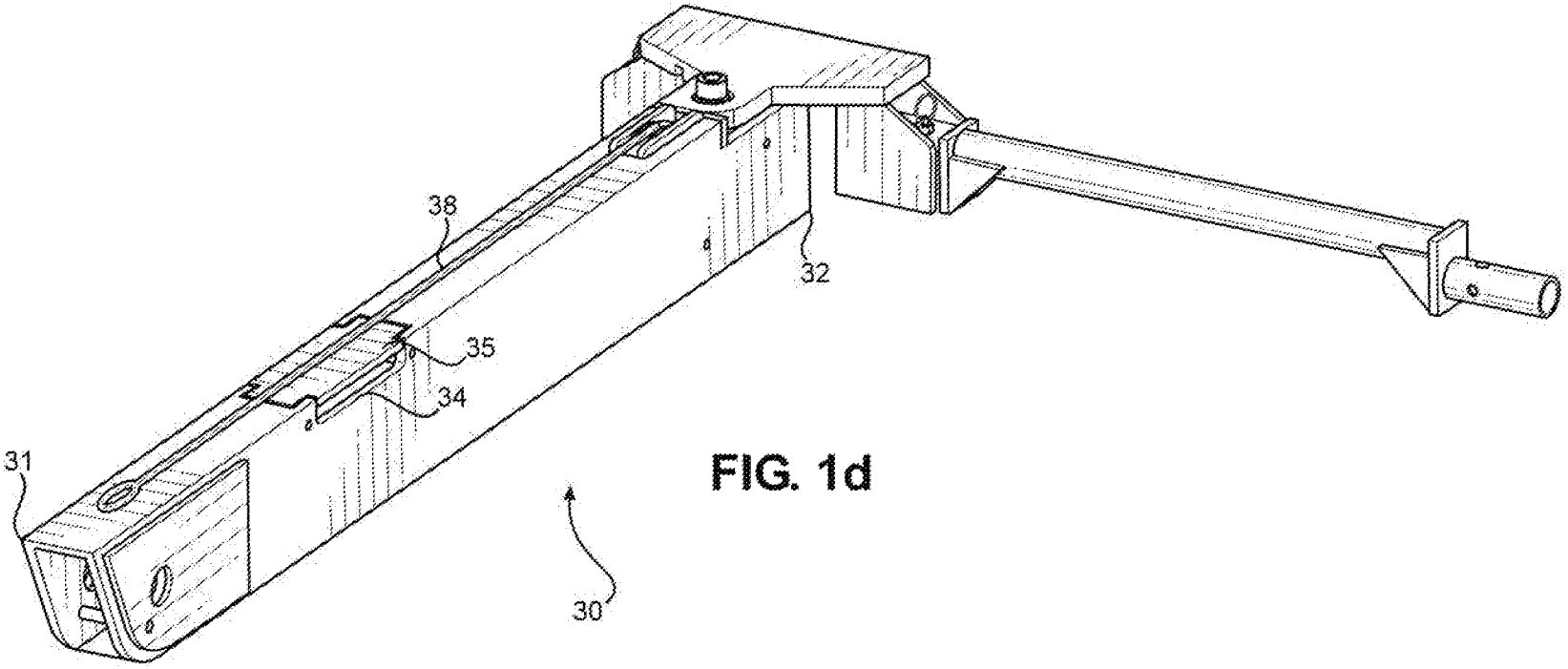
Figure 1E:
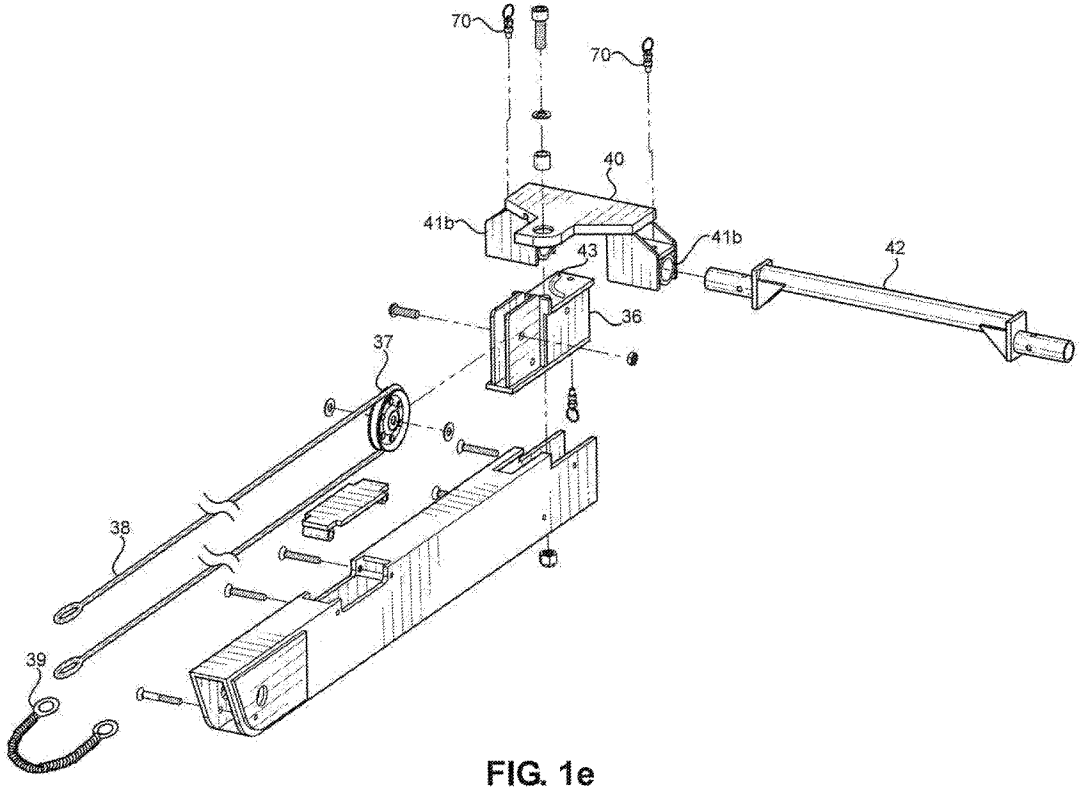

FIGS. 1*d* and 1*e* illustrate perspective and magnified views, respectively, of an exemplary embodiment of a vertical barrier component.

Figure 2:
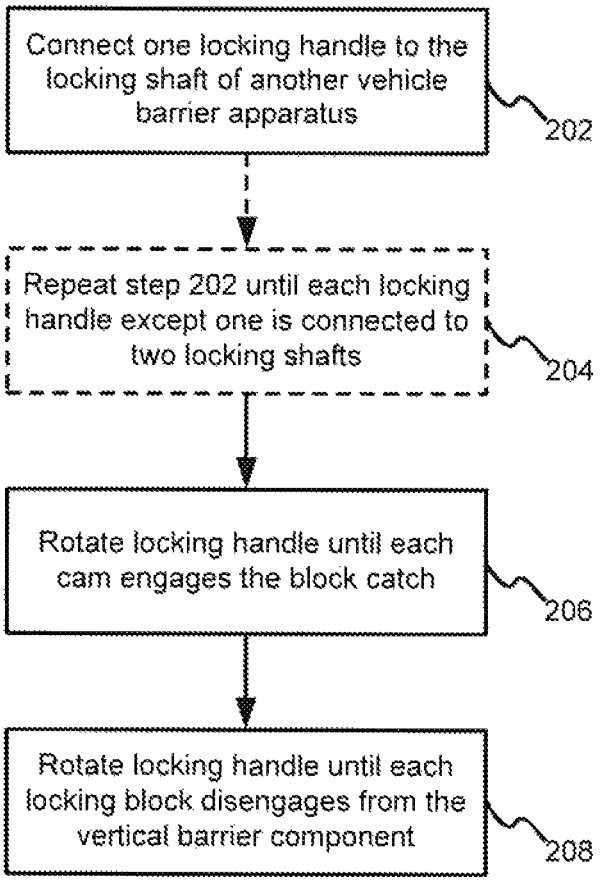

FIG. 2 illustrates a flowchart of a method for deploying an exemplary embodiment of a vehicle barrier system.

TERMS OF ART

As used herein, the term "biasing spring" means a spring used to bias a locking block into a storage position.

As used herein, the term "block stop plate" means a plate which prevents a locking block from traveling beyond a certain point.

As used herein, the term "distal" means further away from a reference point

As used herein, the term "locking block" means a block-shaped component which can prevent movement of one or more parts of the vehicle barrier apparatus when in a storage position.

As used herein, the term "proximal" means closer to a reference point.

As used herein, the term "pulley block" means a block or casing to which a pulley is mounted.

As used herein, the term "remote actuator" means a mechanism capable of moving or controlling at least part of a device.

As used herein, the term "rotating cam channel" means a tubular component having a cam on an outer surface and capable of rotation.

As used herein, the term "stabilizer beam" means a horizontal component supporting and stabilizing a vertical barrier component.

As used herein, the term "stabilizer flange" means a ground-level horizontal protrusion.

As used herein, the term "strap stop" means a protrusion in contact with a strap, preventing the strap from sliding beyond a certain point.

As used herein, the term "tensioning cable" means a cable component under tension in a storage position.

As used herein, the term "tensioning spring" means a spring component under tension in a storage position.

DETAILED DESCRIPTION OF THE INVENTION

FIG. 1*a* illustrates a perspective view of an exemplary embodiment of a vehicle barrier apparatus 100. FIGS. 1*b* and 1*c* illustrate perspective and magnified views, respectively, of an exemplary embodiment of a stabilizer beam 10. FIGS. 1*d* and 1*e* illustrate perspective and magnified views, respectively, of an exemplary embodiment of a vertical barrier component 30.

Vehicle barrier apparatus 100 includes stabilizer beam 10 rotatably connected to vertical barrier component 30. Movement of a locking block 50 in stabilizer beam 10 allows a user to raise vertical barrier component 30 using a tensioning cable 38 and a tensioning spring 39. In the exemplary embodiment, stabilizer beam 10 and vertical barrier component 30 are substantially manufactured from aluminum. In certain embodiments, the aluminum is a 6061-T6 alloy. In certain embodiments, vertical barrier component 30 may also have a coating, cover, or attachment which displays indicia or increases visibility.

In the exemplary embodiment, vehicle barrier apparatus 100 includes at least one horizontal barrier 80 removably attached to stabilizer beam 10 to prevent a target vehicle from gaining traction with a road surface below horizontal barrier 80. In various embodiments, horizontal barrier 80 may be a single horizontal barrier 80 attached to a single vehicle barrier apparatus 100, a single horizontal barrier 80 attached to multiple vehicle barrier apparatuses 100, or multiple horizontal barriers 80 attached to a single vehicle barrier apparatus 100.

At least one strap 60 looped around both stabilizer beam 10 and vertical barrier component 30 keeps vertical barrier component 30 from overextending during deployment or during impact by the target vehicle. Strap 60 may be 2-ply, 3-ply, or 4-ply nylon. In other embodiments, strap 60 is composed of polyester, steel, or para-aramid fiber. In certain embodiments, strap 60 includes multiple straps. Strap 60 is a removable loop, the circumference of which allows a user to alter the angle formed between stabilizer beam 10 and vertical barrier component 30. As the function of vehicle barrier apparatus 100 requires, a user may replace one strap 60 with another strap 60 having a smaller loop, to reduce the angle, or with another strap 60 having a larger loop, to increase the angle. Strap 60 can also be replaced if worn or damaged.

The majority of connections in vehicle barrier apparatus 100 are pin connections 70. In the exemplary embodiment, pin connections 70 are retractable spring plungers for ease of connection in rough field conditions. In the exemplary embodiment, pin connections 70 are also stainless steel to prevent reaction with the aluminum of stabilizer beam 10 and vertical barrier component 30.

Stabilizer beam 10 connects to vertical barrier component 30 at a proximal end 11. During storage, the majority of vertical barrier component 30 nests within central channel 13, which extends from proximal end 11 to a distal end 12. Channel walls 14*a* and 14*b* extend vertically from horizontal stabilizer flanges 15*a* and 15*b*, respectively, to define central channel 13. Stabilizer flanges 15*a* and 15*b* provide lateral stability to vehicle barrier apparatus 100. A block stop plate 16 is a vertical plate extending between channel walls 14*a* and 14*b* at proximal end 11. A cable attachment pin 17 also extends between channel walls 14*a* and 14*b* at proximal end 11 and forms a first attachment point for tensioning cable 38.

Locking channels 18*a* and 18*b* extend from channel walls 14*a* and 14*b*, respectively, proximally of block stop plate 16. A rotating cam channel 19 includes a cam 20 on an outside surface. Cam 20 gradually extends approximately 0.5 inches over approximately 90 degrees, allowing cam 20 to catch one end of locking block 50 as rotating cam channel 19 rotates. Rotating cam channel 19 extends between locking channels 18*a* and 18*b*, so that an inserted locking shaft 21 extends first through locking channel 18*a*, then through rotating cam channel 19, and finally through locking channel 18*b*. Locking shaft 21 is fixedly connected to rotating cam channel 19 such that rotation of locking shaft 21 also rotates rotating cam channel 19. In the exemplary embodiment, the fixed connection is made by removable set screws. In other embodiments, the fixed connection is made by pins, bolts, adhesives, or any other type of connector known in the art.

One end of a locking handle 22 is pivotably connected to one end of locking shaft 21. Locking handle 22 may be used to rotate locking shaft 21. Locking handle 22 has a storage position atop one of stabilizer flanges 15*a* or 15*b*, and a connecting position forming a straight angle with locking shaft 21. A handle retainer 23 extends from one of stabilizer flanges 15*a* or 15*b* and prevents locking handle 22 from becoming dislodged from the storage position during storage or transportation. At least one block support 24 extends between stabilizer flanges 15*a* and 15*b*, below central channel 13 to support locking block 50 in sliding proximally and distally. Strap stops 25*a* and 25*b* extend laterally from stabilizer flanges 15*a* and 15*b*, respectively, to prevent strap 60 from sliding along stabilizer beam 10.

At least one mat connection plate 26 extends from stabilizer flanges 15*a* and 15*b*. Mat connection plate 26 forms a removable connection with horizontal barrier 80 and can serve as a spreader bar to ensure horizontal barrier 80 stays in a properly deployed configuration. In certain embodiments, mat connection plate 26 includes connection structures to allow direct connection to horizontal barrier 80.

At least one beam connector plate 27 with a u-shaped cross-section connects vehicle barrier apparatus 100 to another vehicle barrier apparatus 100. Each arm of the u-shaped beam connector plate 27 is inserted into a different central channel 13, connecting the stabilizer beams 10 of different vehicle barrier apparatuses 100. In certain embodiments, beam connector plate 27 tapers from a proximal point to a distal point to allow a vehicle to drive over an undeployed vehicle barrier apparatus 100.

Vertical barrier component 30 is a substantially hollow element having a lower end 31 and an upper end 32. Lower end 31 rotatably connects to proximal end 11 of stabilizer beam 10 by a connecting bolt 33. At least one strap notch 34 on an upper surface of vertical barrier component 30 prevents strap 60 from sliding along vertical barrier component 30 during deployment. Strap 60 is further held in place by a cover plate 35 extending over strap 60 and strap notch 34. Because cover plate 35 is made of a stronger material than vertical component 30, cover plate 35 also provides reinforcement to vertical barrier component 30 during impact by the target vehicle. In the exemplary embodiment, cover plate 35 is made from steel. Pulley block 36 is located within upper end 32 and holds cable pulley 37 in place.

Tensioning cable 38 extends from cable attachment pin 17, over cable pulley 37, to at least one tensioning spring 39. Tensioning cable 38 is a flexible, non-elastic cable. In the exemplary embodiment, a quick connector connects tensioning cable 38 to tensioning spring 39. In the exemplary embodiment, tensioning spring 39 is a band of elastomeric material extending around connecting bolt 33 such that both ends of tensioning spring 39 connect to tensioning cable 38. In certain embodiments, tensioning spring 39 is covered by a protective layer or replaceable if damaged or stretched out. During deployment, the force exerted by tensioning spring 39 transfers along tensioning cable 38 to raise vertical barrier component 30. Tensioning spring 39 may be replaced if damaged, worn, or otherwise unusable.

Rotatable vertical connector plate 40 is rotatably attached to upper end 32. Rotatable vertical connector plate 40 includes at least two vertical connector channels 41*a* and 41*b*. A removable vertical connector 42 extends from vertical connector channel 41*a*. Vertical connector channel 41*b* receives a removable vertical connector 42 extending from another rotatable vertical connector plate 40. Plate groove 43 is an incised, helical groove in upper end 32 that provides a track for rotation of rotatable vertical connector plate 40 through a range of approximately 90 degrees.

Locking block 50 is made up of an upper block flange 51 and a lower block flange 52 connected by a block flange connector 53 and a locking block plate 54. Upper block flange 51 and lower block flange 52 are horizontal, substantially planar elements. Block flange connector 53 is a vertical, substantially planar element with a curved distal edge to accommodate contact with the curved lower end 31 of vertical barrier component 30. Locking block plate 54 is a vertical, substantially planar, T-shaped element connected to the proximal edges of upper block flange 51, lower block flange 52, and block flange connector 53. Locking block plate 54 provides additional strength to locking block 50 and also provides an engagement surface for a biasing spring 55. Biasing spring 55 extends between block stop plate 16 and locking block plate 54 to bias locking block 50 in a distal direction, toward lower end 31 of vertical barrier component 30. In a storage position, biasing spring 55 biases locking block 50 into contact with lower end 31 of vertical barrier component 30. This prevents vertical barrier component 30 from rising into a deployed position, even though tensioning spring 39 exerts a force on tensioning cable 38.

Block catch 56 extends from block flange connector 53 through block stop plate 16. When a user rotates locking handle 22, cam 20 on rotating cam channel 19 catches and moves block catch 56 proximally, against the biasing force of biasing spring 55. This movement disengages locking block 50 from vertical barrier component 30, allowing the force exerted by tensioning spring 39 on tensioning cable 38 to raise vertical barrier component 30 from a storage position. This allows a user to store vehicle barrier apparatus 100 flat and raise vertical barrier component 30 when deployed. This also allows selective deployment of vertical barrier component 30; a user may keep vehicle barrier apparatus 100 in the flat storage position to allow passage of ordinary vehicles, and raise vertical barrier component 30 to stop a suspicious vehicle.

As shown in FIG. 1*a*, multiple vehicle barrier apparatuses 100 may combine into a vehicle barrier system 300 to cover a wider road or other area. A critical feature of vehicle barrier apparatus 100 is the fact that multiple vehicle barrier apparatuses 100 can be connected by a user and deployed simultaneously by actuating only a single locking handle 22. Each locking handle 22 on one vehicle barrier apparatus 100 may connect to the locking shaft 21 of another vehicle barrier apparatus 100, resulting in a series of alternating locking shafts 21 and locking handles 22. The final locking handle 22 in the sequence may then be used to rotate all locking shafts 21 and deploy all associated vertical barrier components 30 of all vehicle barrier apparatuses 100.

This configuration reduces the time needed to deploy multiple vehicle barrier apparatuses 100. The interconnected configuration also ensures that a user does not need to stand in front of an approaching vehicle to deploy any vehicle barrier apparatus 100 or combination thereof. This reduces the likelihood that a user could be injured by a vehicle attempting to break through vehicle barrier apparatuses 100. In certain embodiments, the safety margin increases through the use of at least one remote actuator connected to the final locking handle 22. This remote actuator may be a hydraulic, pneumatic, or electric motor actuator.

FIG. 2 illustrates a flowchart of method 200 for deploying an exemplary embodiment of vehicle barrier system 300.

In step 202, method 200 connects locking handle 22 of one of a plurality of vehicle barrier apparatuses 100 to locking shaft 21 of another of the plurality of vehicle barrier apparatuses 100.

In optional step 204, method 200 repeats step 202 until each locking handle 22 except for a locking handle 22 used as an actuator handle is connected to two locking shafts 21.

In step 206, method 200 rotates locking handle 22 used as an actuator handle until each cam 20 engages the block catch 56 of a vehicle barrier apparatus 100.

In step 208, method 200 rotates locking handle 22 used as an actuator handle until each locking block 50 disengages from the lower end 31 of vertical barrier component 30 of a vehicle barrier apparatus 100.

It will be understood that many additional changes in the details, materials, procedures and arrangement of parts, which have been herein described and illustrated to explain the nature of the invention, may be made by those skilled in the art within the principle and scope of the invention as expressed in the appended claims. Moreover, the term "approximately" as used herein may be applied to modify any quantitative representation that could permissibly vary without resulting in a change in the basic function to which it is related.

It should be further understood that the drawings are not necessarily to scale; instead, emphasis has been placed upon illustrating the principles of the invention.

What is claimed is:

1. A rapid deployment assembly for a barrier, comprising:

a tensioning cable extending from a proximal end of a stabilizer beam to at least one tensioning spring locating within a lower end of a vertical barrier;

a locking block having a block catch extending proximally therefrom, where said locking block is located within a central channel of a stabilizer beam at said proximal end and said block catch extends beyond a block stop plate located at said proximal end;

a biasing spring located between said block stop plate and said locking block;

a rotating cam channel located between a plurality of locking channels at said proximal end, wherein said rotating cam channel has at least one cam extending from an outer surface, wherein each of said plurality of locking channels extends from one of a plurality of channel walls in said stabilizer beam;

a locking shaft extending through said rotating cam channel and said plurality of locking channels, wherein said locking shaft is fixed to said rotating cam channel and rotatable within said plurality of locking channels; and a locking handle pivotably coupled to said locking shaft.

2. The assembly of claim 1, wherein said locking block includes:

an upper block flange and a lower block flange, each having a horizontal, substantially planar configuration;

a block flange connector having a vertical, substantially planar configuration with a curved distal edge, wherein said block flange connector connects said upper block flange to said lower block flange;

a locking block plate having a vertical, substantially planar configuration, wherein said locking block plate is connected to proximal edges of said upper block flange, said lower block flange, and said block flange connector.

3. The assembly of claim 1, wherein said cam extends approximately 0.5 inches over approximately 90 degrees.

4. The assembly of claim 1, wherein said at least one tensioning spring is a band of elastomeric material.

5. A barrier apparatus with a rapid deployment assembly, comprising:

a stabilizer beam having a proximal end, a distal end, and a central channel located between a plurality of channel walls and extending from said proximal end to said distal end, said central channel having a block stop plate at said proximal end;

a vertical barrier component having a lower end and an upper end, wherein said lower end is rotatably connected to said proximal end by a connecting bolt;

a tensioning cable extending from said proximal end to at least one tensioning spring locating within said lower end of said vertical barrier;

a locking block having a block catch extending proximally therefrom, where said locking block is located within said central channel at said proximal end and said block catch extends beyond said block stop plate;

a biasing spring located between said block stop plate and said locking block;

a rotating cam channel located between a plurality of locking channels at said proximal end, wherein said rotating cam channel has at least one cam extending from an outer surface, wherein each of said plurality of locking channels extends from one of said plurality of channel walls;

a locking shaft extending through said rotating cam channel and said plurality of locking channels, wherein said locking shaft is fixed to said rotating cam channel and rotatable within said plurality of locking channels;

a locking handle pivotably coupled to said locking shaft; and at least one strap extending around said stabilizer beam and said vertical barrier.

6. The apparatus of claim 5, further including at least one stabilizer flange extending horizontally from at least one of said plurality of channel walls from said proximal end to said distal end.

7. The apparatus of claim 5, further including at least one strap stop extending horizontally from at least one of said plurality of channel walls.

8. The apparatus of claim 5, wherein said vertical barrier further includes a strap notch between said lower end and said upper end, wherein said at least one strap is located within said strap notch.

9. The apparatus of claim 8, further including at least one cover plate extending over said strap notch.

10. The apparatus of claim 5, further including a vertical connector plate rotatably connected to said upper end, said vertical connector plate having a plurality of vertical connector channels, wherein at least one removable vertical connector is located within at least one of said plurality of vertical connector channels.

11. The apparatus of claim 10, wherein said upper end includes at least one plate groove connected to said vertical connector plate, wherein said at least one plate groove comprises a helically incised groove.

12. The apparatus of claim 5, further including a pulley rotatably attached to a pulley block, wherein said pulley block is located within said upper end, wherein said tensioning cable extends over said pulley.

13. The apparatus of claim 5, wherein said at least one tensioning spring extends around said connecting bolt such that both ends of said at least one tensioning spring connect to said tensioning cable.

14. The apparatus of claim 5, further including at least one remote actuator connected to said locking handle.

15. The apparatus of claim 5, wherein said vertical barrier component forms an angle with said stabilizer beam ranging from approximately 15 degrees to approximately 90 degrees.

16. The apparatus of claim 5, further including at least one horizontal barrier component, wherein said at least one horizontal barrier component includes a lower barrier surface having a friction-enhanced surface, wherein said friction-enhanced surface creates a sliding friction interface upon contact of a moving target vehicle with said vertical barrier component.

17. The apparatus of claim 16, further including at least one mat connector plate interconnecting said at least one horizontal barrier component and said stabilizer beam.

18. A barrier system with a plurality of rapid deployment assemblies, comprising a plurality of vehicle barrier apparatuses, wherein each of said plurality of vehicle barrier apparatuses comprises:

a stabilizer beam having a proximal end, a distal end, and a central channel located between a plurality of channel walls and extending from said proximal end to said distal end, said central channel having a block stop plate at said proximal end, a vertical barrier component having a lower end and an upper end, wherein said lower end is rotatably connected to said proximal end by a connecting bolt, a tensioning cable extending from said proximal end to at least one tensioning spring locating within said lower end of said vertical barrier, a locking block having a block catch extending proximally therefrom, where said locking block is located within said central channel at said proximal end and said block catch extends beyond said block stop plate, a biasing spring located between said block stop plate and said locking block, a rotating cam channel located between a plurality of locking channels at said proximal end, wherein said rotating cam channel has at least one cam extending from an outer surface, wherein each of said plurality of locking channels extends from one of said plurality of channel walls, a locking shaft extending through said rotating cam channel and said plurality of locking channels, wherein said locking shaft is fixed to said rotating cam channel and rotatable within said plurality of locking channels, a locking handle pivotably coupled to said locking shaft, and at least one strap extending around said stabilizer beam and said vertical barrier, wherein said locking handle of one of said plurality of vehicle barrier apparatuses is removably connected to said locking shaft of another of said plurality of vehicle barrier apparatuses.

19. The system of claim 18, further including at least one beam connector plate, said at least one beam connector plate having a u-shaped cross-section, wherein said at least one beam connector plate connects one stabilizer beam to another stabilizer beam.

20. The system of claim 19 wherein said at least one beam connector plate decreases from a first height at a proximal point to a second height at a distal point.

* * * * *